US006261432B1

(12) United States Patent
Huber et al.

(10) Patent No.: US 6,261,432 B1
(45) Date of Patent: Jul. 17, 2001

(54) PROCESS FOR THE PRODUCTION OF AN OBJECT WITH A HOLLOW SPACE

(75) Inventors: Heinz Huber, Haar; Heinz Voggenreiter, München, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/063,620

(22) Filed: Apr. 20, 1998

(30) Foreign Application Priority Data

Apr. 19, 1997 (DE) ..... 197 16 524

(51) Int. Cl.[7] ..... C25D 1/02

(52) U.S. Cl. ..... 205/73

(58) Field of Search ..... 205/73; 427/446, 427/456

(56) References Cited

U.S. PATENT DOCUMENTS

| | | | | |
|---|---|---|---|---|
| 3,645,491 | * | 2/1972 | Brown et al. | 249/61 |
| 3,963,818 | * | 6/1976 | Sakoda et al. | 264/56 |
| 4,132,607 | * | 1/1979 | Painter et al. | 204/9 |
| 4,438,804 | * | 3/1984 | Aiga et al. | 164/522 |
| 4,480,681 | * | 11/1984 | Alexander et al. | 164/522 |
| 4,722,770 | * | 2/1988 | Blottiere et al. | 204/9 |
| 4,902,386 | * | 2/1990 | Herbert et al. | 204/9 |
| 5,097,586 | * | 3/1992 | Sawyer | 29/527 |
| 5,127,461 | * | 7/1992 | Matsunaga et al. | 164/16 |

* cited by examiner

*Primary Examiner*—Kathryn Gorgos
*Assistant Examiner*—Erica Smith-Hicks
(74) *Attorney, Agent, or Firm*—Ladas & Parry

(57) ABSTRACT

A water soluble core of an aluminum or magnesium alloy is used for the production of an object with a hollow space. The aluminum or magnesium alloy is rendered water-soluble by flame spraying or by sintering to produce a high oxide content.

8 Claims, 1 Drawing Sheet

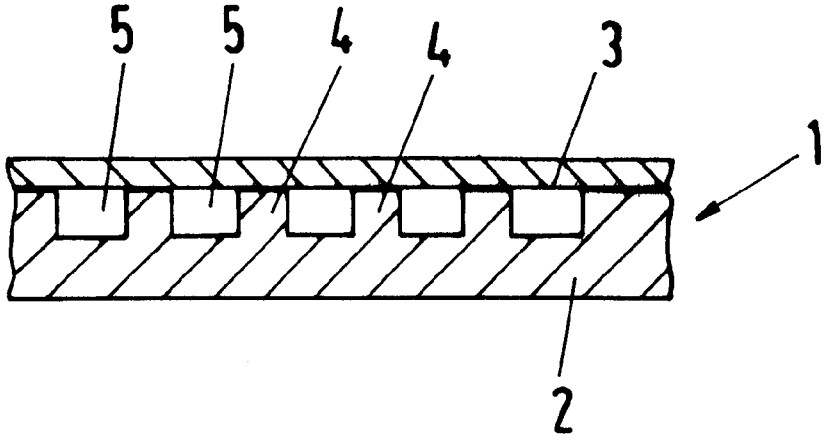
5
5
4
4
3
1
2

PROCESS FOR THE PRODUCTION OF AN OBJECT WITH A HOLLOW SPACE

FIELD OF THE INVENTION

The invention relates to a process for the production of a molded object with at least one hollow space and particularly to an object molded with a water soluble core which is subsequently dissolved to produce the hollow space.

BACKGROUND

For the production of molded objects with a hollow space, sand cores and salt cores are used in casting technology, and the cores are dissolved after casting to form the hollow space in the cast body. Both sand cores and molded salt cores, however, have a low mechanical strength. They are thus difficult to handle. Because of their low strength, in practice they are usable only in casting technology for producing molded objects, but not in other processes for producing molded objects.

It is further known to use cores of electrically conducting wax in the production of molded objects with hollow spaces by electrolytic deposition, and the wax is then melted out. The disadvantage of this process, among others, is that one is limited, in the selection of materials, to metals that are suitable for electrolytical deposition.

SUMMARY OF THE INVENTION

An object of the invention is to provide a method to produce a core for the production of an object with at least one hollow space, which core can be removed rapidly and simply from the object in order to form the hollow space, and which has a high mechanical strength.

This is achieved according to the invention by the process for producing an object having a hollow space comprising forming the object with a water-soluble core corresponding to the hollow space to be obtained, dissolving said core to form said hollow space, and forming said water-soluble core from of an aluminum or magnesium alloy.

Objects of any size and shape can be produced with hollow spaces of any number, size and shape according to the process of the invention, if cores of the appropriate number, size and shape are used. Not only can hollow objects be produced, but, for example, if the hollow spaces have open pores, objects of more or less high porosity can be produced.

The water-soluble core used in the process according to the invention is comprised of an aluminum or a magnesium alloy. It thus has a high mechanical strength. It may therefore be utilized not only as a core in casting technology, but also for other processes, in which an object is formed on or around the core or cores. Thus, the core used according to the invention may be coated, for example, by thermal spraying. Since the core is electrically conductive, it is also suitable for electrolytic coating.

The molded object produced according to the process of the invention may thus be comprised of any material, i.e., metal, ceramic or plastic.

Alloys of magnesium and particularly of aluminum are dissolved by their passivation in water, but only very slowly, if at all. Surprisingly, it has now been found that molded objects or layers of aluminum or magnesium alloys completely lose this property and very rapidly dissolve in water, if they have been produced by thermal spraying.

This can be attributed to the high oxide content and/or the high porosity, which arises when the aluminum or magnesium alloy is used as a spray material in thermal spraying.

Preferably, the core according to the invention has a porosity of at least 1% by volume and/or an oxide content of at least 1% by weight. In general, the higher the oxide content or the higher the porosity, the more rapidly the core dissolves. On the other hand, too high a porosity or too high an oxide content leads to great reduction of the mechanical strength of the core.

A porosity of 5 to 25 vol. % and an oxide content of 5 to 30 wt. % are particularly preferred. Such a porosity or such an oxide content is obtained, if the core is produced by conventional thermal spray processes, particularly by conventional flame spraying.

In addition to the thermal spraying process, the core according to the invention may also be produced by sintering. In order to assure a sufficiently high oxide content of the core, a sintering powder with a correspondingly high oxide content is preferably used, for example, a sintering powder that has been produced from a molten aluminum or magnesium alloy in an atmosphere containing oxygen or water.

Sintering may be effected by hot isostatic pressing (HIP) or by cold isostatic pressing (ClP).

The aluminum is alloyed preferably with one or more metals from groups Ia, IIa, IIIa, IVa and Va of the Periodic Table. The magnesium is alloyed preferably with one or more metals from groups Ia, IIa, IIIa, IVa and Va of the Periodic Table.

Tin, zinc and magnesium are particularly suitable as alloy components for the aluminum alloy. As has been found, for example, a core of an aluminum alloy of 70 to 90 wt. % aluminum and 10 to 30 wt. % tin has a very high rate of dissolution.

In general, the content of the alloy components in the aluminum alloy or the magnesium alloy is at least 1 wt. %, and preferably 5 to 40 wt. %.

The dissolution of the core, according to the invention, may be achieved with neutral water, or with an aqueous alkali or acid, as long as the molded object is not attacked thereby.

The dissolution of the aluminum or magnesium alloy in water is a very intensely exothermic reaction. The heat that is produced leads to a considerable acceleration of the dissolution process.

BRIEF DESCRIPTION OF THE DRAWING

An embodiment of the invention will be described in more detail hereafter on the basis of the sole FIGURE of the drawing which is a sectional view through a part of a combustion chamber wall of a rocket engine.

DETAILED DESCRIPTION

Referring to the drawing, therein is seen a wall 1 of a combustion chamber which comprises an inner wall element 2 and an outer wall element 3. The wall elements 2 and 3 are made of metal. Inner wall element 2 is provided with ribs 4, so that cooling channels 5 are formed between outer wall element 3 and inner wall element 2, through which flows, for example, the rocket fuel (e.g., liquid hydrogen or oxygen).

For the production of wall 1, according to the invention, inner wall element 2 with ribs 4 is first produced and then an aluminum alloy is introduced by flame spraying from above onto inner wall element 2 between ribs 4, in order to form cores, which fill channels 5. Then, outer wall element 3 is formed on ribs 4 and the cores in channels 5, for example, by thermal spraying, so that a solid connection between outer wall element 3 and ribs 4 is produced. For the thermal spraying of outer wall element 3, another spraying process, for example, high velocity flame spraying, may be utilized with another spray material, for example, steel. Finally, the assembly of inner wall element 2 and outer wall element 3 with flame-prayed aluminum alloy cores in channels 5 is immersed in a water bath to dissolve the cores.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. A process for producing an object having a hollow space comprising forming the object with a water-soluble core corresponding to the hollow space to be obtained, dissolving said core to form said hollow space, and forming said water-soluble core from an aluminum or magnesium alloy, said water-soluble core of aluminum or magnesium alloy being formed with a porosity of 5 to 25 vol. % and an aluminum or magnesium oxide content of 5 to 30 wt. %, said aluminum and magnesium alloy having an alloy content of 5 to 40 wt %.

2. A process as claimed in claim 1, comprising producing said core by thermal spraying or sintering.

3. A process as claimed in claim 2, wherein said thermal spraying is effected by flame spraying.

4. A process as claimed in claim 1, wherein the aluminum alloy comprises aluminum alloyed with at least one metal selected from groups Ia to Va of the Periodic Table and the magnesium alloy comprises magnesium alloyed with at least one metal selected from groups Ia to Va of the Periodic Table.

5. A process as claimed in claim 4, wherein the alloying metal of the aluminum alloy is at least one metal selected from the group consisting of tin, zinc and magnesium.

6. A process as claimed in claim 1, wherein the core is dissolved by melting said core to form said hollow space.

7. A process as claimed in claim 1, comprising forming at least a portion of said object on said core by thermal spraying.

8. A process as claimed in claim 1, comprising forming at least a portion of said object on said core by electrolytic deposition.

* * * * *